US007021570B2

(12) United States Patent
Tani et al.

(10) Patent No.: US 7,021,570 B2
(45) Date of Patent: Apr. 4, 2006

(54) FUEL INJECTION DEVICE HAVING INJECTION HOLE PLATE

(75) Inventors: Yasuhide Tani, Nagoya (JP); Kimitaka Saito, Nagoya (JP); Nobuo Ota, Takahama (JP); Yoshitaka Wakamatsu, Gamagori (JP)

(73) Assignee: Denso Corporation, (JP)

( * ) Notice: Subject to any disclaimer, the term of this patent is extended or adjusted under 35 U.S.C. 154(b) by 14 days.

(21) Appl. No.: 10/619,607

(22) Filed: Jul. 16, 2003

(65) Prior Publication Data

US 2004/0069873 A1 Apr. 15, 2004

(30) Foreign Application Priority Data

Jul. 29, 2002 (JP) ..... 2002-219644
Jul. 29, 2002 (JP) ..... 2002-219671
Aug. 9, 2002 (JP) ..... 2002-233096

(51) Int. Cl.
*B05B 1/00* (2006.01)

(52) U.S. Cl. ..... 239/596; 239/533.14; 239/533.2; 239/585.1; 239/585.5

(58) Field of Classification Search .. 239/585.1–585.5, 239/596, 600, 408, 409, 533.1–533.15
See application file for complete search history.

(56) References Cited

U.S. PATENT DOCUMENTS 5,273,215 A * 12/1993 Hans et al. ..... 239/288.5
5,390,411 A 2/1995 Vogt et al.
5,540,387 A 7/1996 Reiter et al.
5,570,843 A 11/1996 Heyse et al.
5,680,992 A * 10/1997 Grytz et al. ..... 239/408
5,718,387 A 2/1998 Awarzamani et al.
5,899,390 A * 5/1999 Arndt et al. ..... 239/553
5,921,474 A * 7/1999 Zimmermann et al. .. 239/585.1
5,924,634 A * 7/1999 Arndt et al. ..... 239/553
5,944,262 A 8/1999 Akutagawa et al.
6,050,507 A * 4/2000 Holzgrefe et al. ..... 239/585.1
6,170,763 B1 1/2001 Fuchs et al.
6,296,199 B1 10/2001 Noller et al.
6,712,297 B1 * 3/2004 Sugiyama et al. ..... 239/585.2
6,783,087 B1 * 8/2004 Aoki et al. ..... 239/596

(Continued)

FOREIGN PATENT DOCUMENTS

DE 19907859 A1 3/2000

(Continued)

OTHER PUBLICATIONS

Patent Abstracts of Japan, vol. 2002, No. 11, Nov. 6, 2002 & JP 2002 202032 A (Unisia Jecs Corp. Jul. 19, 2002.

*Primary Examiner*—David A. Scherbel
*Assistant Examiner*—Seth Barney
(74) *Attorney, Agent, or Firm*—Nixon & Vanderhye PC

(57) ABSTRACT

A nozzle holder includes a support portion, which supports a downstream end surface of a planar wall of an injection hole plate. The injection hole plate provided with injection holes is welded to one of the valve body and the nozzle holder. The planar wall may be curved and may be thus convex in an upstream direction toward a downstream end opening such that the planar wall is urged against a peripheral edge of the downstream end opening of the valve body. The planar wall may include a reinforcing rib located radially outward of the injection hole.

25 Claims, 9 Drawing Sheets

U.S. PATENT DOCUMENTS

| | | | |
|---|---|---|---|
| 2002/0100821 | A1 | 8/2002 | Yukinawa et al. |
| 2002/0124405 | A1 | 9/2002 | Hasegawa et al. |
| 2002/0130206 | A1 | 9/2002 | Kobayashi et al. |
| 2002/0170987 | A1 | 11/2002 | Aoki et al. |
| 2003/0127540 | A1 | 7/2003 | Xu |
| 2003/0127547 | A1 | 7/2003 | Nowak |
| 2003/0136374 | A1 | 7/2003 | Kobayashi et al. |

FOREIGN PATENT DOCUMENTS

| | | | |
|---|---|---|---|
| DE | 10059007 | A1 | 5/2002 |
| EP | 1327771 | A2 | 7/2003 |
| JP | 11-117832 | | 4/1999 |
| JP | 2000-73918 | | 3/2000 |
| JP | 2003-232271 | | 8/2003 |

* cited by examiner

FUEL INJECTION DEVICE HAVING INJECTION HOLE PLATE

CROSS REFERENCE TO RELATED APPLICATION

This application is based on and incorporates herein by reference Japanese Patent Application No. 2002-219671 filed on Jul. 29, 2002, Japanese Patent Application No. 2002-219644 filed on Jul. 29, 2002 and Japanese Patent Application No. 2002-233096 filed on Aug. 9, 2002.

BACKGROUND OF THE INVENTION

1. Field of the Invention

The present invention relates to a fuel injection device.

2. Description of Related Art

For example, Japanese Unexamined Patent Publication Number 2000-73918 discloses one type of fuel injection device (also referred to as an injector). With reference to FIG. 13, in this fuel injection device, fuel is injected through injection holes 156 formed through a planar injection hole plate 152. In general, in such a fuel injection device, it is possible to increase a level of atomization by enhancing agitation of fuel flow through the injection holes. When fuel flows through each injection hole, which extends in a fuel injection direction, the injection hole tends to stratify the fuel flow. Thus, when the length of the injection hole in its passage direction is reduced, atomization of fuel mist can be further promoted. Because of this, when the planar injection hole plate 152 is thinned to reduce the length of the injection hole 156 in its passage direction, the atomization of fuel mist can be further promoted.

However, when the injection hole plate is thinned, there is an increased possibility of fatigue destruction of the injection hole plate caused by the fuel pressure. Thus, when the injection hole plate is thinned, the injection hole plate should be reinforced by another member. Particularly, in a case of a fuel injection device, which directly injects fuel into a corresponding combustion chamber of a gasoline engine, fuel pressure reaches 5–12 MPa, which is 16 to 40 times greater than that of a fuel injection device, which injects fuel into an intake pipe, so that it is required to provide a sufficient strength in the injection hole plate.

For example, in the fuel injection device shown in FIG. 13, a retainer plate 154 is provided adjacent to a downstream end surface of the injection hole plate 152, which is located on a side opposite from a valve body 150. The retainer plate 154 is welded to a cylindrical sleeve 158, which is, in turn, welded to the valve body 150. In this way, the injection hole plate 152 is secured relative to the valve body 150. Through reinforcement of the injection hole plate 152 by the retainer plate 154, even when the injection hole plate 152 is thinned to some degree, sufficient safety of the injection hole plate 152 against fatigue destruction can be achieved by the retainer plate 154.

However, for example, in the case of the retainer plate 154 and the sleeve 158 shown in FIG. 13, the number of components is increased, disadvantageously resulting in an increased structural complexity and an increased manufacturing costs. Furthermore, the assembly operation of the plates are tedious, and thus industrial productivity of the fuel injection device is reduced.

Also, in the Japanese Unexamined Patent Publication Number 2000-73918, there is also disclosed another type of fuel injection device, in which the injection hole plate and the retainer plate are both welded to the valve body. In this fuel injection device, the plates are welded to the valve body at once while the plates are partially overlapped with each other. Thus, energy consumption at the time of welding is disadvantageously increased to increase the manufacturing costs, and the time required for welding is also disadvantageously lengthened, resulting in the reduced industrial productivity of the fuel injection device.

SUMMARY OF THE INVENTION

Thus, it is an objective of the present invention to provide a fuel injection device, which is capable of promoting atomization of fuel mist and has a simple structure.

It is another objective of the present invention to provide a fuel injection device, which allows a reduction in manufacturing costs and an increase in industrial productivity.

To achieve the objectives of the present invention, there is provided a fuel injection device that includes a valve body, a valve member, an injection hole plate and a nozzle holder. The valve body includes a downstream end opening, a fuel passage communicated with the downstream end opening and a valve seat located adjacent to the downstream end opening. The valve member is located radially inward of the valve body and is seatable against the valve seat of the valve body. The injection hole plate includes a cover wall, which covers the downstream end opening of the valve body. The cover wall includes at least one injection hole formed through the cover wall. The nozzle holder receives the valve body. The nozzle holder includes a support portion, which supports a downstream end surface of the cover wall of the injection hole plate. The injection hole plate is welded to one of the valve body and the nozzle holder.

To achieve the objectives of the present invention, there is also provided a fuel injection device that includes a valve body, a valve member, an injection hole plate and a nozzle holder. The valve body includes a downstream end opening, a fuel passage communicated with the downstream end opening and a valve seat located adjacent to the downstream end opening. The valve member is located radially inward of the valve body and is seatable against the valve seat of the valve body. The injection hole plate includes a cover wall, which covers the downstream end opening of the valve body. The cover wall includes at least one injection hole formed through the cover wall. The nozzle holder receives the valve body. The nozzle holder includes a support portion, which supports a downstream end surface of the cover wall of the injection hole plate. The cover wall of the injection hole plate is curved and is thus convex in an upstream direction toward the downstream end opening such that the cover wall is urged against a peripheral edge of the downstream end opening of the valve body.

To achieve the objectives of the present invention, there is also provided a fuel injection device that includes a valve body, a valve member, an injection hole plate and a nozzle holder. The valve body includes a downstream end opening, a fuel passage communicated with the downstream end opening and a valve seat located adjacent to the downstream end opening. The valve member is located radially inward of the valve body and is seatable against the valve seat of the valve body. The injection hole plate includes a cover wall, which covers the downstream end opening of the valve body. The cover wall includes at least one injection hole formed through the cover wall. The nozzle holder receives the valve body. The nozzle holder includes a support portion, which supports a downstream end surface of the cover wall of the injection hole plate. The cover wall of the injection hole plate includes a thin wall portion and a thick wall portion. The thin wall portion covers the downstream end opening of the valve body, and the thick wall portion is formed around the thin wall portion. The at least one injection hole is formed through the thin wall portion of the cover wall.

To achieve the objectives of the present invention, there is also provided a fuel injection device that includes a valve body, a valve member and an injection hole plate. The valve body includes a downstream end opening, a fuel passage communicated with the downstream end opening and a valve seat located adjacent to the downstream end opening. The valve member is located radially inward of the valve body and is seatable against the valve seat of the valve body. The injection hole plate includes a cover wall, which covers the downstream end opening of the valve body. The cover wall includes at least one injection hole formed through the cover wall. The cover wall includes a reinforcing rib located radially outward of the injection hole. A portion of the cover wall, which has a projecting length smaller than that of the reinforcing rib, is welded to the valve body.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

A first embodiment of the present invention will be described with reference to the accompanying drawings.

Figure 1:
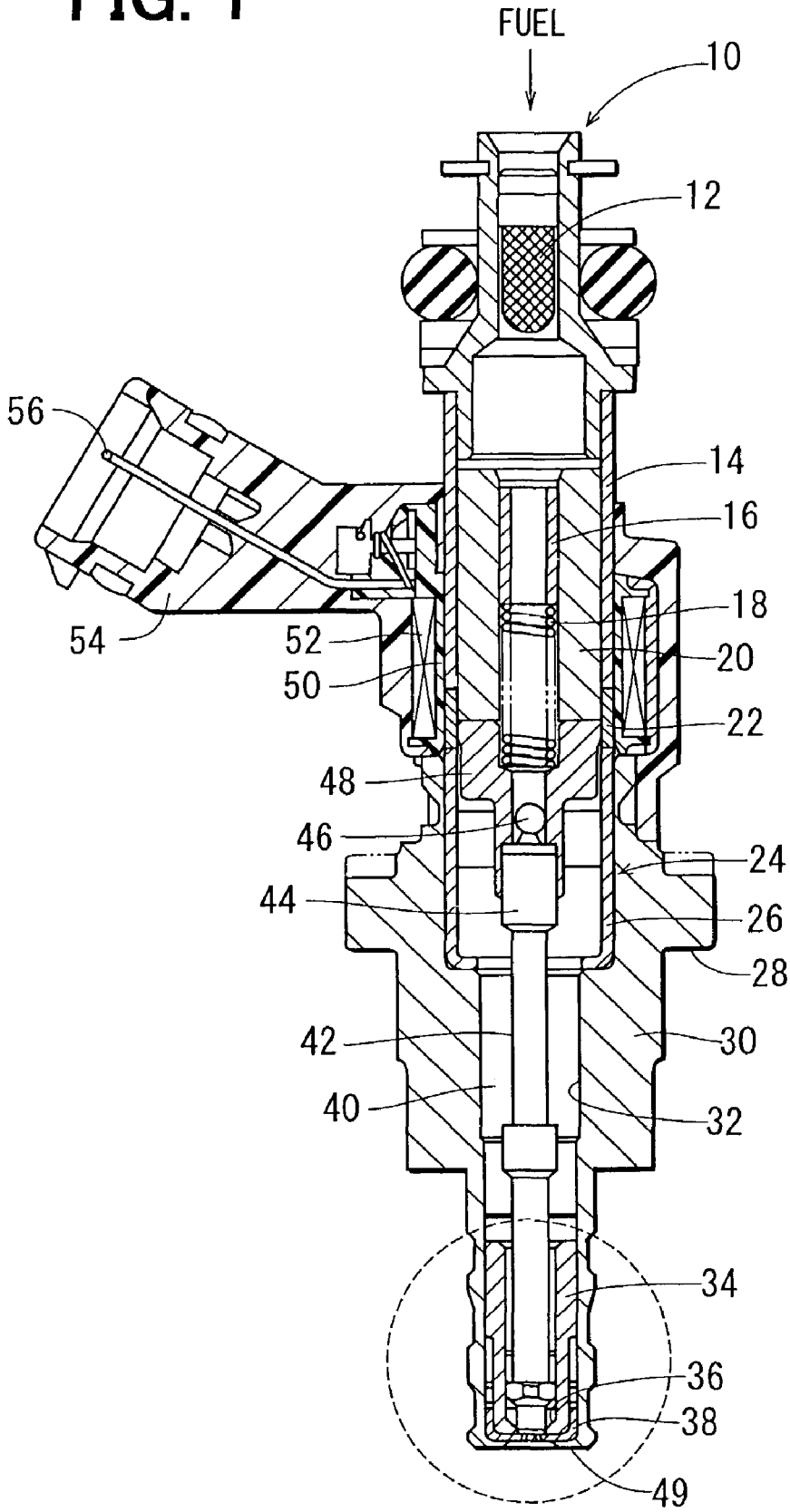
FIG. 1 is a cross sectional view showing a fuel injection device according to a first embodiment of the present invention.
Figure 2:
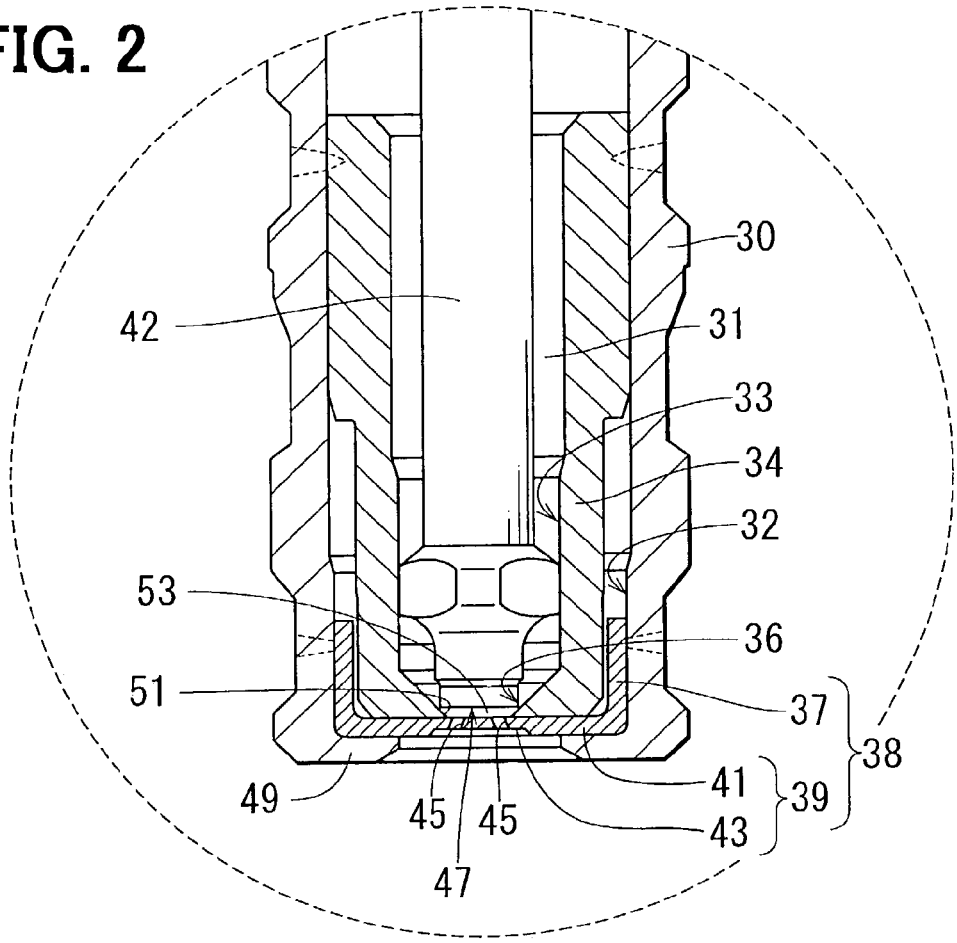
FIG. 2 is a partially enlarged view of FIG. 1, showing an encircled portion of FIG. 1.
Figure 3:
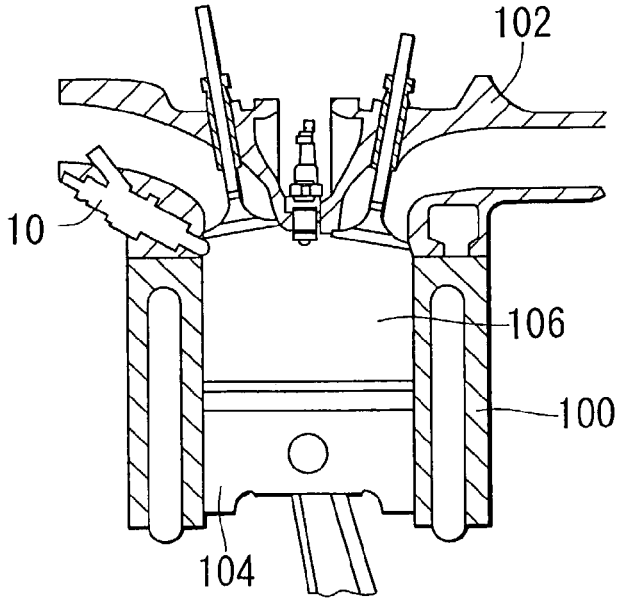
FIG. 3 is a cross sectional view showing an installation position of the fuel injection device according to the first embodiment.

FIG. 1 is a cross sectional view of a fuel injection device (also referred to as an injector) 10 according to a first embodiment of the present invention, and FIG. 2 is a partially enlarged view of the fuel injection device 10. FIG. 3 is a cross sectional view showing an installation position of the fuel injection device 10.

In the present embodiment, with reference to FIG. 3, the fuel injection device 10 is a fuel injection device for a gasoline engine of a direct injection type, which directly injects fuel into a combustion chamber 106 of the gasoline engine. The fuel injection device 10 is installed to a cylinder head 102, which surrounds the combustion chamber 106. It should be understood that the present invention can be alternatively embodied in another fuel injection device, which injects fuel into an intake pipe. Furthermore, the present invention is not limited to the gasoline engine and can be embodied in a diesel engine.

With reference to FIGS. 1 and 2, a nozzle holder 30 includes a flange 28 and is inserted into a corresponding receiving hole, which is formed in the cylinder head 102 (FIG. 3). At the time of inserting the nozzle holder 30 into the receiving hole, the flange 28 abuts against the cylinder head 102, so that the nozzle holder 30 is positioned relative to the cylinder head 102. The nozzle holder 30 includes a cylindrical inner peripheral wall 32, which has an inner diameter that decreases in a stepwise manner toward the combustion chamber. An injection hole plate 38, a valve body 34 and a nozzle needle 42 are received in this order from a combustion chamber side in a cylindrical inner space 40, which is surrounded by the inner peripheral wall 32. A support portion 49 is formed in a downstream end (i.e., a combustion chamber side end) of the nozzle holder 30. The support portion 49 is bent to extend along a downstream end surface (i.e., a combustion chamber side end surface) of the injection hole plate 38. The support portion 49 is formed into an annular shape. An inner diameter of the support portion 49 is smaller than an outer diameter of the injection hole plate 38. An upstream end surface of the support portion 49 located on the side opposite from the combustion chamber supports a downstream end surface of a generally planar wall (serving as a cover wall of the present invention) 39 of the injection hole plate 38 located on the side opposite from the valve body 34. The injection hole plate 38 is reinforced without increasing the number of components by providing the nozzle holder 30 with the support portion 49, which is formed by extending the nozzle holder 30 to the downstream end surface of the planar wall 39 of the injection hole plate 38 located on the side opposite from the valve body 34 and then by bending the nozzle holder 30 along the injection hole plate 38 on the combustion chamber side in contact with the injection hole plate 38. The shape of the support portion 49 is not limited to the annular shape and can be any other suitable shape that is formed by bending the nozzle holder 30 along the injection hole plate 38 on the combustion chamber side thereof to support the downstream end surface of the planar wall 39 on the side opposite from the valve body 34. Furthermore, the nozzle holder 30 of the present embodiment functions to position the valve body 34 relative to the cylinder head 102 through the flange 28. In the present invention, the nozzle holder 30 does not need to function in that way, and thus the nozzle holder 30 can be any suitable member that is capable of receiving the valve body 34. For example, a member, which receives the valve body 34, and a member, which positions the fuel injection device 10 relative to the cylinder head 102, can be separately provided.

The injection hole plate 38 is received in the portion of the inner space 40 of the nozzle holder 30, which is closest to the combustion chamber 106. A preferred material of the injection hole plate 38 includes, for example, stainless. As shown in FIG. 2, the injection hole plate 38 includes the planar wall 39 and a peripheral wall 37, which extends from an outer peripheral edge of the planar wall 39 in an upstream direction (i.e., in an upward direction in FIG. 2). Thus, the injection hole plate 38 is shaped into a cup body that has a bottom wall. The injection hole plate 38 is formed, for example, by drawing a stainless steel plate into the cup shape. It should be noted that the injection hole plate 38 can be modified into a form of an entirely flat plate having no peripheral wall 37.

The peripheral wall 37 of the injection hole plate 38 is cylindrical and is engaged with the inner peripheral wall 32 of the nozzle holder 30. By engaging the peripheral wall 37 with the inner peripheral wall 32 of the nozzle holder 30, the injection hole plate 38 is radially positioned relative to the nozzle holder 30 with high precision. The peripheral wall 37 is welded to the inner peripheral wall 32 of the nozzle holder 30 by laser beam, which is irradiated along the entire perimeter of an outer peripheral wall surface of the nozzle holder 30. When the peripheral wall 37 is laser welded to the nozzle holder 30 while the planar wall 39 is clamped between the nozzle holder 30 and the valve body 34, the injection hole plate 38 is axially position relative to the nozzle holder 30 with high precision. Furthermore, when the peripheral wall 37 is welded to the nozzle holder 30 along the entire perimeter, it is possible to prevent leakage of fuel through a space between the outer peripheral wall surface of the peripheral wall 37 and the nozzle holder 30 toward an outlet side of the injection holes 45 after leakage through a space between the valve body 34 and the planar wall 39.

Figure 4A:
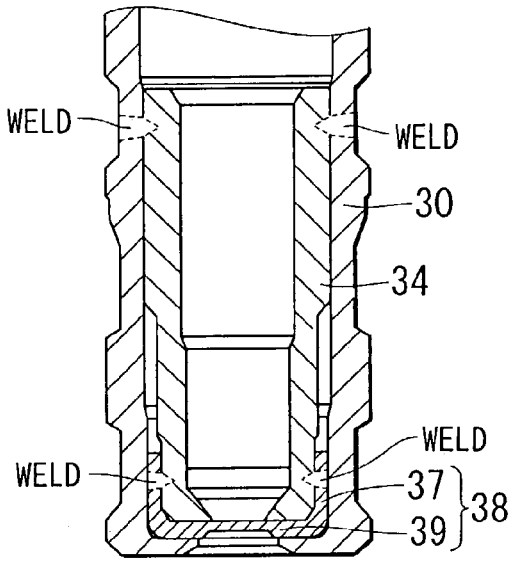
FIG. 4A is a cross sectional view showing one modification of a welding structure of an injection hole plate according to the first embodiment.
Figure 4B:
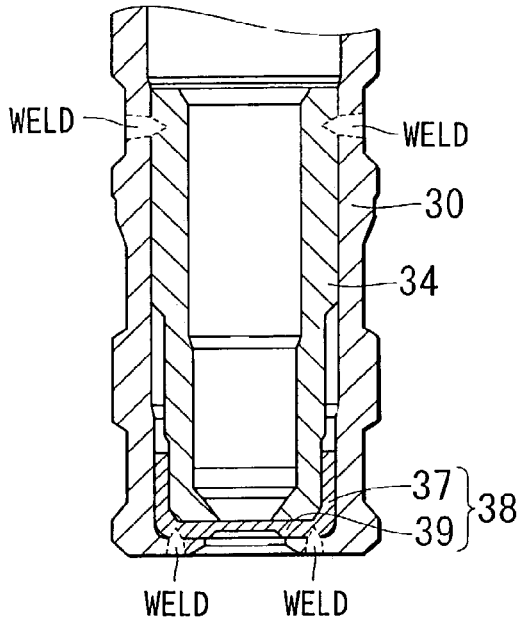
FIG. 4B is a cross sectional view showing another modification of the welding structure of the injection hole plate.
Figure 4C:
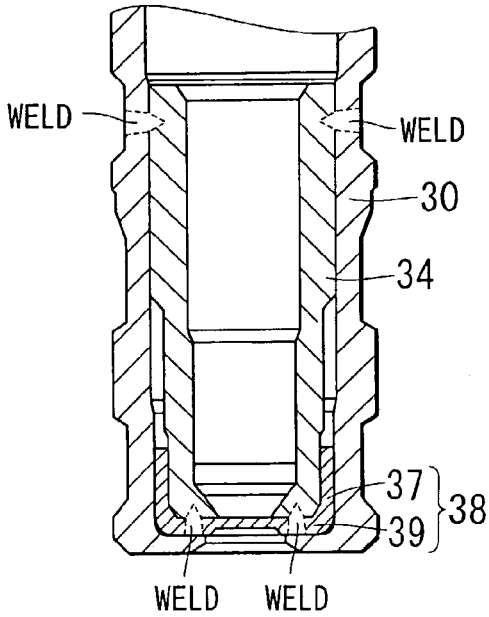
FIG. 4C is a cross sectional view showing a further modification of the welding structure of the injection hole plate.

FIGS. 4A–4C show cross sectional views of modifications of the welding structure of the injection hole plate 38. As shown in FIG. 4A, the peripheral wall 37 may be engaged with the valve body 34, and the peripheral wall 37 may be welded to the valve body 34. Alternatively, as shown in FIG. 4B, the planar wall 39 may be welded to the nozzle holder 30. Further alternatively, as shown in FIG. 4C, the planar wall 39 may be welded to the valve body 34. In the case where the valve body 34 and the injection hole plate 38 are laser welded together, it is required to provide a way of preventing thermal deformation of the valve body 34 to achieve a high accuracy of a size of a valve seat 36.

As shown in FIG. 2, the planar wall 39 of the injection hole plate 38 is shaped into a circular disk, which has a circular recess in the center of the circular disk on the downstream side (i.e., the combustion chamber side) thereof. The planar wall 39 includes a circular thin wall portion 43 and an annular thick wall portion 41, which extends along the outer peripheral portion of the thin wall portion 43. A wall thickness of the thin wall portion 43 is preferably equal to or greater than a value obtained by multiplying a wall thickness of the thick wall portion 41 by 0.4 but is less than a value obtained by multiplying the wall thickness of the thick wall portion 41 by 1. By thickening the thick wall portion 41 while thinning the thin wall portion 43, the length of the injection hole 45 in its passage direction can be shortened while maintaining the strength of the planar wall 39. The downstream end surface of the thick wall portion 41 located on the side opposite from the valve body 34 is supported by the support portion 49 of the nozzle holder 30. Preferably, an outer diameter of the thick wall portion 41 is equal to or less than a value obtained by multiplying an inner diameter of a downstream end opening 51 of the valve body 34 by 2 (two). By reducing a ratio of the thin wall portion 43 relative to the entire planar wall 39 in the above described manner, the safety of the planar wall 39 against the fatigue destruction can be improved. The plurality of injection holes 45 is formed in the thin wall portion 43. By providing the plurality of injection holes 45, an effective fuel mist configuration can be achieved. However, it should be noted that the number of injection holes 45 can be changed to one. The atomization of the fuel mist is further enhanced when the length of the injection hole 45 in its passage direction is further shortened relative to the inner diameter of the injection hole 45. Accordingly, the wall thickness of the thin wall portion 43 is desirably equal to or less than a value obtained by multiplying the inner diameter of the injection hole 45 by 2 (two).

Figure 5:
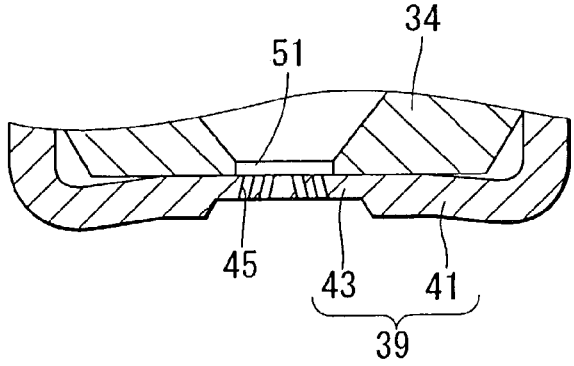
FIG. 5 is an enlarged schematic partial cross sectional view showing a generally planar wall of the injection hole plate according to the first embodiment.

FIG. 5 is a schematic view showing the planar wall 39 of the injection hole plate 38. The planar wall 39 is arranged such that the thin wall portion 43 of the planar wall 39 covers a downstream end opening 51 formed in the valve body 34. Furthermore, the planar wall 39 is slightly curved and is thus convex in the upstream direction toward the opening 51. By slightly curving the planar wall 39 in the upstream direction toward the opening 51, the planar wall 39 can be urged against a peripheral edge of the opening 51 of the valve body 34. When the planar wall 39 is urged against the peripheral edge of the opening 51 of the valve body 34, the fuel pressure is applied only to the inner portion of the planar wall 39 located inside the opening 51, and the fuel pressure is not applied to the outer portion of the planar wall 39 located outside the opening 51. When the pressure receiving surface area of the planar wall 39 is reduced, the fuel pressure is increased. However, deformation of the planar wall 39 by the fuel pressure is restrained. Furthermore, by curving the thin wall portion 43 of the planar wall 39 in the upstream direction toward the opening 51, deformation of the thin wall portion 43, which could be induced when external force is applied to the thin wall portion 43 from the upstream side of the opening 51, can be restrained. The safety of the planar wall against the fatigue destruction can be improved by increasing the effect of increasing the safety of the planar wall against the fatigue destruction, which is achieved by restraining deformation of the planar wall, over the effect of reducing the safety of the planar wall against the fatigue destruction, which is induced by an increase in the fuel pressure.

As shown in FIG. 2, the valve body 34 is secured to the inner peripheral wall 32 of the nozzle holder 30 by the laser welding. The distal end surface of the valve body 34 is engaged with the planar wall 39 of the injection hole plate 38. The cylindrical inner peripheral wall 33 of the valve body 34 defines a fuel passage 31 therein. The conical valve seat 36 is formed in the inner peripheral wall 33 of the valve body 34. When the nozzle needle 42 is seated against valve seat 36, the fuel passage 31 is closed. The opening 51 located at the downstream end of the fuel passage 31 corresponds to a downstream end opening of the present invention. The opening 51 is covered with the thin wall portion 43 of the injection hole plate 38.

The nozzle needle 42 serves as a valve member of the present invention. A downstream end surface (i.e., a distal end surface) 47 of the nozzle needle 42 located on the injection hole plate side thereof has a flat circular shape. When the nozzle needle 42 is seated against the valve seat 36, the distal end-surface 47 of the nozzle needle 42 and the injection hole plate 38 are positioned in close proximity to each other. Thus, a generally flat fuel space 53, which is defined by the distal end surface (downstream end surface) 47 of the nozzle needle 42, the injection hole plate 38 and the inner peripheral wall 33 of the valve body 34, has a frustum shape, which is relatively narrow in the axial direction and is relatively wide in the radial direction.

As shown in FIG. 1, a tubular member (housing) 24 is received in an upstream end of the inner space 40 of the nozzle holder 30 located on the side opposite from the combustion chamber and is secured to the nozzle holder 30 by welding. The tubular member 24 includes a first magnetic portion 26, a non-magnetic portion 22 and a second magnetic portion 14, which are arranged in this order from the combustion chamber side. The non-magnetic portion 22 prevents magnetic short circuit between the first magnetic portion 26 and the second magnetic portion 14.

A movable core 48 is made of a magnetic material and is formed into a cylindrical shape. The movable core 48 is securely welded to an upstream end 44 of the nozzle needle 42 located on the side opposite from the injection holes 45. The movable core 48 reciprocates together with the nozzle needle 42 in the inner space of the tubular member 24. A drain hole 46, which penetrates through a cylindrical wall of the movable core 48, forms a fuel passage that communicates between the inside of the cylindrical wall of the moveable core 48 and outside of the cylindrical wall of the moveable core 48.

A stationary core 20 is made of a magnetic material and is formed into a cylindrical shape. The stationary core 20 is inserted into the inner space of the tubular member 24 and is secured to the tubular member 24 by welding. The stationary core 20 is arranged on an upstream side of the movable core 48, which is opposite from the combustion chamber, and is opposed to the movable core 48.

An adjusting pipe 16 is a tubular member, which is press fitted into the stationary core 20 and forms a fuel passage. A spring 18 has one end engaged with the adjusting pipe 16 and the other end engaged with the movable core 48. By adjusting the press fitting depth of the adjusting pipe 16, load of the spring 18 applied to the movable core 48 can be changed. The movable core 48 and the nozzle needle 42 are urged toward the valve seat 36 by the urging force of the spring 18.

A coil 52 is wound around a spool 50. A terminal 56 is insert molded in a connector 54 and is electrically connected to the coil 52. When electric power is supplied to the coil 52, a magnetic attractive force is exerted between the movable core 48 and the stationary core 20, and the movable core 48 is attracted toward the stationary core 20 against the urging force of the spring 18.

A filter 12 is arranged upstream of the stationary core 20 and removes debris and dust from fuel supplied to the fuel injection device 10 through a pipe (not shown). Fuel supplied into the stationary core 20 through the filter 12 passes through the fuel passage of the adjusting pipe 16, the drain hole 46 of the movable core 48, the inner space 40 of the nozzle holder 30 and the fuel passage 31 of the valve body 34.

When the nozzle needle 42 is lifted away from the valve seat 36, the fuel passage 31 of the valve body 34 is opened, and thus fuel is injected through the injection holes 45. At this time, fuel flows are supplied into the fuel space 53, which is defined between the distal end surface 47 of the nozzle needle 42 and the injection hole plate 38, through the annular space defined between the valve seat 36 and the nozzle needle 42. The fuel flows supplied into the fuel space 53 are guided by the distal end surface 47 of the nozzle needle 42 and the injection hole plate 38 toward the center of the annular space, which is defined between the valve seat 36 and the nozzle needle 42, and collide with each other to form a turbulent flow. Then, the fuel is supplied into the injection holes 45 and is discharged through the injection holes 45. When the fuel is supplied into the injection holes 45 as the turbulent flow and is discharged through the injection holes 45 without being stratified by the injection holes 45, the atomization of the fuel mist discharged through the injection holes 45 is promoted. Furthermore, when the thickness of the thin wall portion 43 is selected to be equal to less than the value obtained by multiplying the inner diameter of the injection hole by 2, the length of the injection hole 45 is shortened relative to the inner diameter of the injection hole 45. Thus, the stratifying action of the injection hole 45 for stratifying the turbulent fuel flow is reduced. As a result, the atomization of fuel mist is further promoted.

When the fuel is supplied into the fuel space 53 defined between the downstream end surface 47 of the nozzle needle 42 and the injection hole plate 38, the fuel pressure of 5 to 12 MPa is applied to the thin wall portion 43 of the injection hole plate 38. The thick wall portion 41 is formed around the thin wall portion 43 of the injection hole plate 38, and the ratio of the thick wall portion 43 relative to the entire planar wall 39 of the injection hole plate 38 is relatively small. Thus, in comparison to a case where the wall thickness of the planar wall 39 is entirely thinned, deformation of the planar wall 39, which is induced by fuel pressure, is more restrained. Furthermore, the downstream end surface of the planar wall 39 of the injection hole plate 38 located on the side opposite from the valve body 34 is supported by the support portion 49 of the nozzle holder 30. Thus, deformation of the planar wall 39 of the injection hole plate 38 is also restrained by the support portion 49 of the nozzle holder 30. As a result, by forming the thin wall portion 43 in the portion of the injection hole plate 38, by forming the injection holes 45 in the thin wall portion 43, by forming the thick wall portion 41 around the thin wall portion 43, and by supporting the downstream end surface of the planar wall 39 of the injection hole plate 38, which is located on the side opposite from the valve body 34, through use of the nozzle holder 30, atomization of the fuel mist is promoted while the sufficient safety of the injection hole plate 38 against the fatigue destruction induced by the fuel pressure is achieved. Furthermore, the downstream end surface of the planar wall 39 of the injection hole plate 38 located on the side opposite from the valve body 34 is supported by the support portion 49 of the nozzle holder 30. Thus, deformation of the planar wall 39 of the injection hole plate 38 is restrained by the support portion 49 of the nozzle holder 30. Therefore, the thickness of the planar wall 39 can be partially or entirely thinned to reduce the length of the injection hole 45 in its passage direction. As a result, by supporting the downstream end surface of the planar wall 39, which is located on the side opposite from the valve body 34, through use of the nozzle holder 30, atomization of the fuel mist is promoted while the sufficient safety of the injection hole plate 38 against the fatigue destruction induced by the fuel pressure is achieved. Furthermore, by supporting the planar wall 39 of the injection hole plate 38 through use of the nozzle holder 30, the safety of the injection hole plate 38 against the fatigue destruction of the injection hole plate 38 can be improved with the simple structure without increasing the number of components.

(Second Embodiment)

Figure 6:
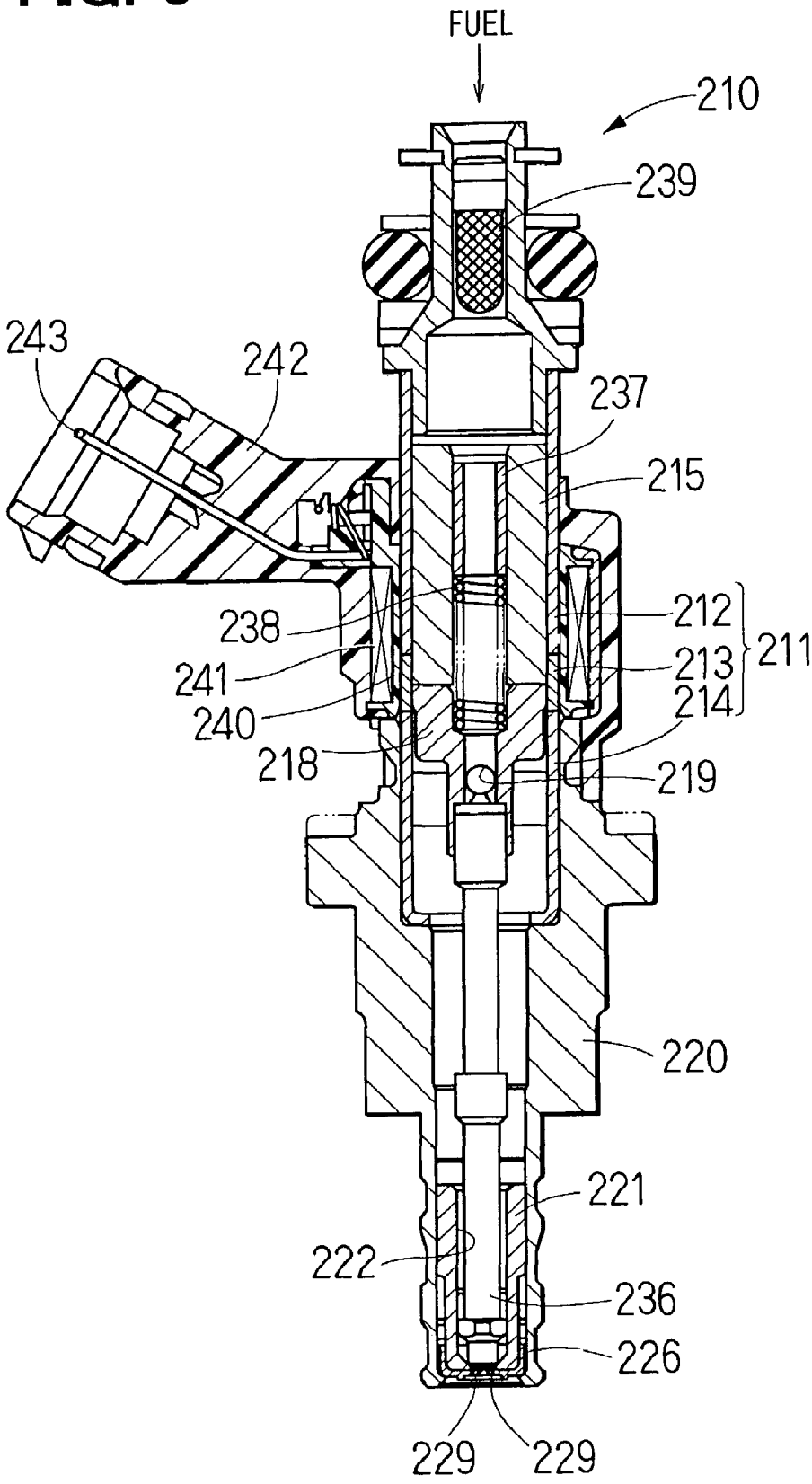
FIG. 6 is a cross sectional view showing a fuel injection device according to a second embodiment of the present invention.
Figure 7:
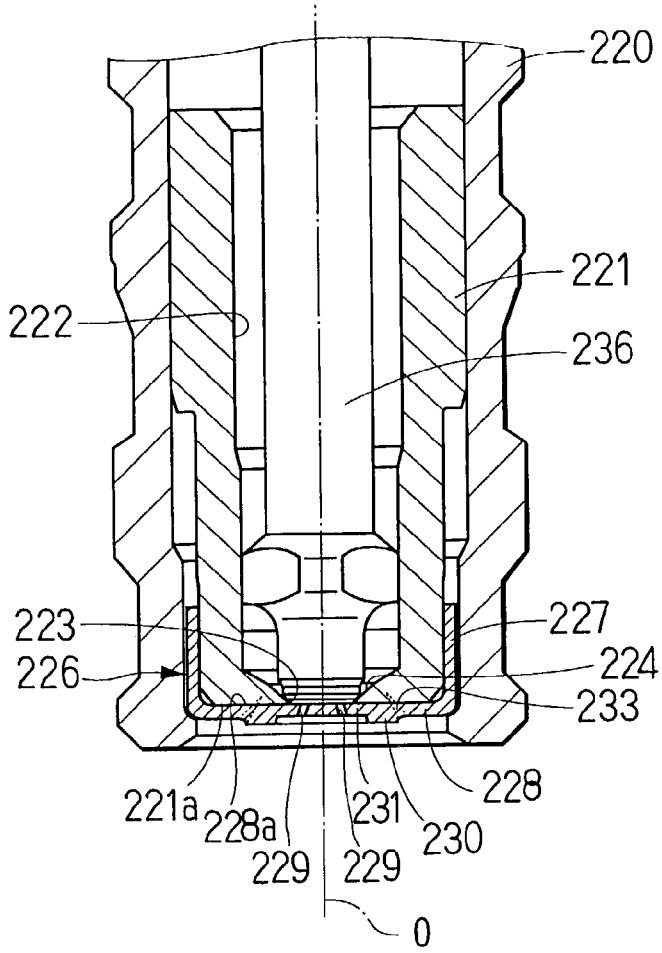
FIG. 7 is a partially enlarged view of FIG. 6, showing a main feature of the fuel injection device according to the second embodiment.
Figure 8:
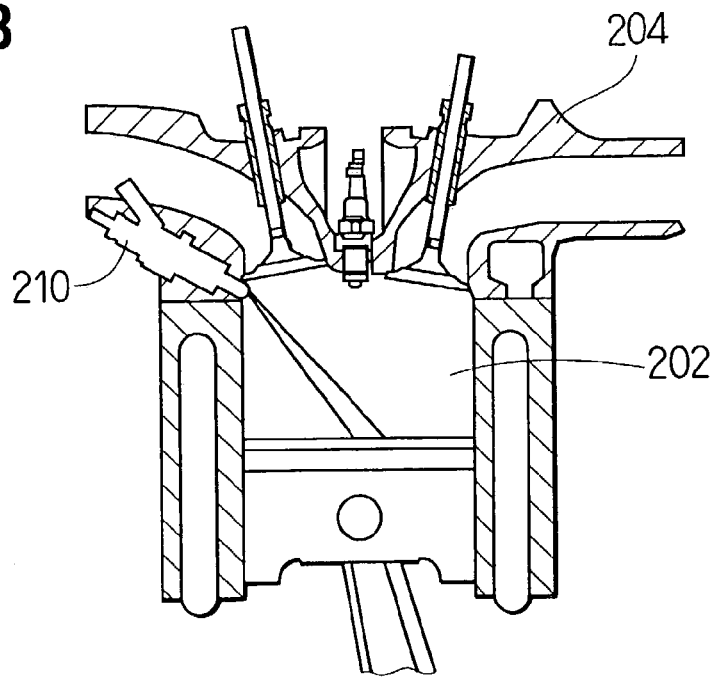
FIG. 8 is a cross sectional view showing installation of the fuel injection device of the second embodiment to an engine.

FIGS. 6 and 7 show a fuel injection device according to a second embodiment of the present invention. With reference to FIG. 8, a fuel injection device 210 according to the second embodiment is installed to a cylinder head 204, which surrounds a combustion chamber 202 of a gasoline engine, and is a direct injection type, which directly injects fuel into the combustion chamber 202.

As shown in FIG. 6, a housing 211 is formed into a cylindrical shape. The housing 211 includes a first magnetic portion 212, a non-magnetic portion 213 and a second magnetic portion 214, which are coaxially arranged. The non-magnetic portion 213 prevents magnetic short circuit between the first magnetic portion 212 and the second magnetic portion 214. A stationary core 215 is made of a magnetic material and is shaped into a cylindrical body. Also, the stationary core 215 is secured coaxially with the housing 211 at a location radially inward of the housing 211. A movable core 218 is made of a magnetic material and is shaped into a cylindrical body. Also, the movable core 218 is coaxially positioned at a location radially inward of the housing 211. The movable core 218 can reciprocate in the axial direction at a location downstream of the stationary core 215. A drain hole 219, which passes through a peripheral wall of the movable core 218, forms a fuel passage that connects between the outside and inside of the movable core 218.

A spool 240 is arranged radially outward of the housing 211, and a coil 241 is wound around the spool 240. A connector 242, which is formed by resin molding, covers outer peripheral portions of the spool 240 and of the coil 241. A terminal 243 is inserted into the connector 242 and is electrically connected to the coil 241. When the coil 241 is powered through the terminal 243, a magnetic attractive force is developed between the stationary core 215 and the movable core 218.

As shown in FIGS. 6 and 7, a nozzle holder 220 is shaped into a cylindrical body and is coaxially secured to a downstream end of the housing 211. A valve body 221 is shaped into a cylindrical body and is securely welded at a location radially inward of the downstream end of the nozzle holder 220. An inner peripheral wall surface of the valve body 221 defines a fuel passage 222. Furthermore, at a location adjacent to a downstream end opening 223 of the valve body 221, the inner peripheral wall surface of the valve body 221 forms a conical valve seat 224, which has an inner diameter that decreases toward the downstream end opening 223.

An injection hole plate 226 is shaped into a cup body, which includes a peripheral wall 227 and a generally planar wall (base wall) 228, through, for example, a drawing process of a stainless steel plate.

Figure 9A:
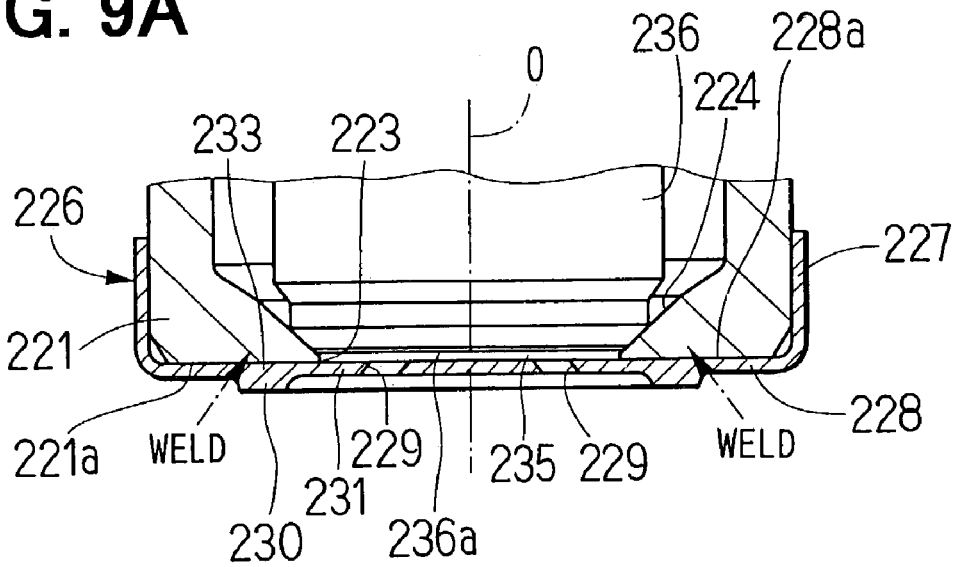
FIG. 9A is an enlarged partial cross sectional view showing welding between an injection hole plate and a valve body in the fuel injection device of the second embodiment.
Figure 9B:
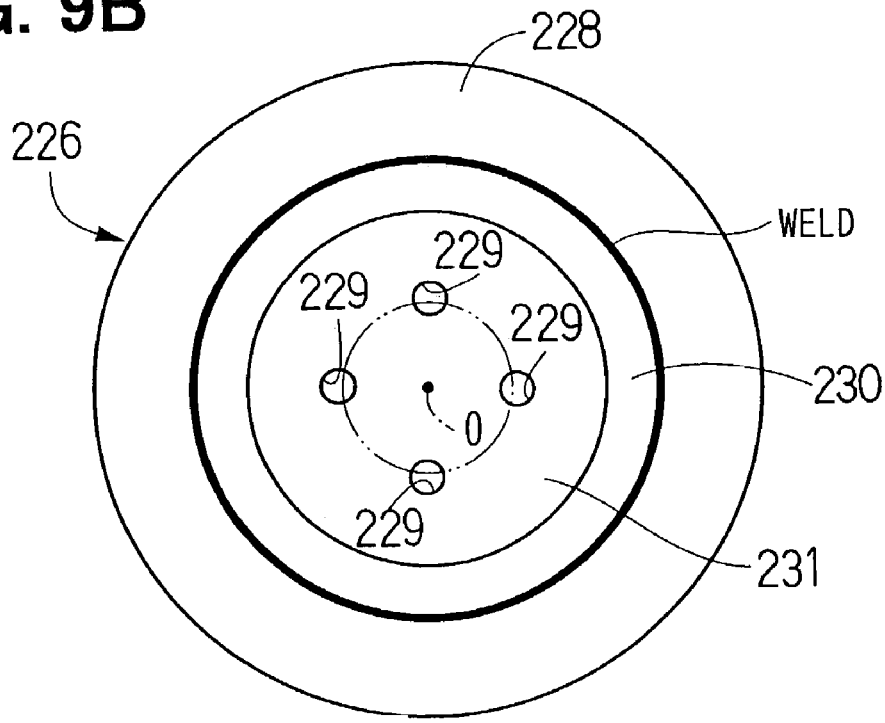
FIG. 9B is a bottom view corresponding to FIG. 9A, showing the welding between the injection hole plate and the valve body in the fuel injection device of the second embodiment.

As shown in FIGS. 7, 9A and 9B, a downstream end of the valve body 221 is coaxially fitted to the peripheral wall 227 at a location radially inward of the peripheral wall 227. An end surface 221*a* of the downstream end of the valve body 221 engages and is covered with an inner wall surface 228*a* of the planar wall 228. That is, the planar wall 228 serves as a cover wall of the present invention. Furthermore, the injection hole plate 226 is radially positioned relative to the valve body 221 through engagement between the peripheral wall 227 and the valve body 221. The nozzle holder 220 surrounds an outer peripheral portion of the peripheral wall 227 while a small clearance is interposed between the nozzle holder 220 and the outer peripheral portion of the peripheral wall 227.

A plurality of injection holes 229 is formed in the center of the planar wall 228 that has a circular disk shape. In the second embodiment, the injection holes 229 are arranged at equal angular intervals along a common circle that is centered at the central axis O of the planar wall 228. A passage direction of each injection hole 229 is angled relative to the central axis O of the planar wall 228 to define a predetermined angle therebetween. It should be understood that an appropriate number of additional injection holes 229 can be provided radially inward of the injection holes 229, which are arranged along the common circle in the manner described above in this embodiment. Furthermore, although an appropriate mist configuration can be easily formed by providing the plurality of injection holes 229, the number of injection holes 229 can be modified to one, if appropriate.

As in the first embodiment, the planar wall (cover wall) 228 includes a thin wall portion 231 and a thick wall portion 230. In the second embodiment, the thick wall portion comprises a reinforcing rib 230. The reinforcing rib 230 is integrally formed in the planar wall 228 in such a manner that the reinforcing rib 230 protrudes on a side opposite from the valve body 221. The reinforcing rib 230 is located radially outward of the radially outermost injection holes 229 and has an annular lateral cross section that extends continuously in the circumferential direction of the planar wall 228. In the present embodiment, all of the injection holes 229 correspond to the radially outermost injection holes 229. However, in the case where the inner injection holes 229 are provided radially inward of the outer injection holes 229 arranged along the common circle, the injection holes 229 except the inner injection holes 229 provided radially inward of the outer injection holes 229 along the common circle correspond to the outermost injection holes 229. Also, in the case where only one injection hole 229 is provided, the only one injection hole 239 corresponds to the outermost injection hole 229. The central axis of the reinforcing rib 230 coincides with the central axis O of the planar wall 229, and an inner diameter of the reinforcing rib 230 is greater than an inner diameter of the opening 223 of the valve body 221. With this arrangement, the opening 223 is covered with a radially inner portion (thin wall portion) 231 of the planar wall 228, which is located radially inward of the reinforcing rib 230. That is, the opening 223 is covered with the thin wall portion 231 of the planar wall 228, in which the injection holes 229 are provided, and the reinforcing rib 230 is not present. Hereinafter, this portion 231 will be referred to as a nozzle portion 231.

Furthermore, in the planar wall 228, a base portion 233 of the reinforcing rib 230 is welded to the valve body 221, so that the injection hole plate 226 is axially positioned. In the present embodiment, as shown in FIG. 9A, the base portion 233 of the reinforcing rib 230 is welded to the downstream end of the valve body 221 all around it by a laser beam irradiated onto the base portion 233 from a point located radially outward of the reinforcing rib 230 in a direction that is angled relative to the central axis O. In this way, as shown in FIG. 9B, the welding portion (or simply referred to as a weld) of the planar wall 228 welded to the valve body 221 extends continuously in the circumferential direction at the location radially outward of the outermost injection holes 229. When the planar wall 228 is welded all around it, a sufficient joining strength of the weld is achieved, and outward leakage of fuel through a space between the valve body 221 and the planar wall 228 and then through a space between the valve body 221 and the peripheral wall 227 can be prevented. Furthermore, when the base portion 233 of the reinforcing rib 230 of the planar wall 228 is welded to the valve body 221, the welding portion is reinforced by the reinforcing rib 230 to increase the joining strength of the weld. Also, in the planar wall 228, the relatively thin base portion 233 of the reinforcing rib 230, which has a projecting length smaller than that of a distal end of the reinforcing rib 230, is welded to the valve body 221. Here, the projecting length is measured from an upstream end surface of the planar wall 228. With this welding structure, energy consumption at the time of welding is reduced, and the time required for welding is also reduced. This allows a reduction in manufacturing costs and an improvement of industrial productivity.

A nozzle needle 236, which serves as a valve member of the present invention, is received radially inward of the housing 211, the nozzle holder 220 and the valve body 221 in coaxial relationship with them. An upstream end of the nozzle needle 236 is connected to the movable core 218 to reciprocate integrally with the movable core 218. A downstream end of the nozzle needle 236 is seatable against the valve seat 224 of the valve body 221. When the nozzle needle 236 is seated against the valve seat 224, communication between a lower end of the fuel passage 222 defined in the valve body 221 and each injection hole 229 of the injection hole plate 226 is prevented. On the other hand, when the nozzle needle 236 is lifted away from the valve seat 224, communication between the fuel passage 222 and each injection hole 229 is allowed. In the present embodiment, as shown in FIGS. 9A and 9B, a downstream end surface 236*a* of the nozzle needle 236 has a generally flat surface. With this arrangement, when the nozzle needle 236 is seated against the valve seat 224, a fuel space 235, which is defined by the downstream end surface 236*a* of the nozzle needle 236, the inner wall surface 228*a* of the planar wall 228 of the injection hole plate 226 and the inner peripheral wall surface of the valve body 221, has a frustum shape, which is relatively narrow in its axial direction and is relatively wide in its radial direction.

With reference to FIG. 6, an adjusting pipe 237 is press fitted radially inward of the stationary core 215 and defines a fuel passage therein. A spring 238 has one end engaged with the adjusting pipe 237 and the other end engaged with the movable core 218. The spring 238 urged the movable core 218 and the nozzle needle 236 toward the valve seat 224. By adjusting an amount of insertion depth of the adjusting pipe 237, a load of the spring 238 applied to the movable core 218 and the nozzle needle 236 can be changed.

A filter 239 is arranged upstream of the stationary core 215 and removes debris and dust from fuel supplied to the fuel injection device 210 through a fuel conducting pipe (not shown). Fuel supplied into the stationary core 215 through the filter 239 passes through the fuel passage of the adjusting pipe 237, the fuel passage of the movable core 218, the fuel passage of the drain hole 219, the fuel passage of the nozzle holder 220 and the fuel passage 222 of the valve body 221.

Figure 10:
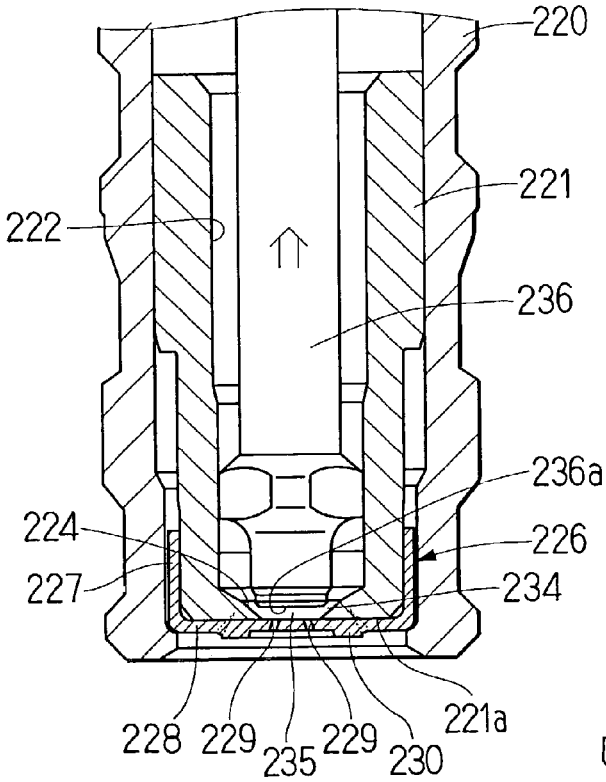
FIG. 10 is a cross sectional view similar to FIG. 8, showing operation of the fuel injection device according to the second embodiment.

In the fuel injection device 210, when the movable core 218 is attracted toward the stationary core 215 upon energization of the coil 241, the nozzle needle 236 is lifted away from the valve seat 224, as shown in FIG. 10. Thus, the fuel passage 222 of the valve body 221 is communicated with each injection hole 229, so that fuel is injected through each injection hole 229. At this time, fuel is supplied into the fuel space 235 located downstream of the space 234 defined between the valve seat 224 and the nozzle needle 236. The fuel supplied into the fuel space 235 is guided along the downstream end surface 236*a* of the nozzle needle 236 and the inner wall surface 228*a* of the planar wall 228 of the injection hole plate 226 and forms a reverse flow, which flow toward the space 234 defined between the valve seat 24 and the nozzle needle 236. The reverse flow, which flows from the fuel space 235 toward the space 234 collide with the forward flow, which flows from the space 234 toward the fuel space 235. Thus, a turbulent flow is formed upon collision of the reverse flow and the forward flow. When the fuel in the form of the turbulent flow is supplied into the injection holes 229 and is injected through the injection holes 229 without being stratified in the injection holes 229, atomization of fuel mist discharged through the injection holes 229 is promoted. Furthermore, in the fuel injection device 210, by minimizing the wall thickness of at least the nozzle portion 231 of the planar wall 228 of the injection hole plate 226, the length of each injection hole 229 in its passage direction can be reduced. In this way, the fuel flow stratifying action of each injection hole 229 is reduced, and thus the atomization of fuel mist is further promoted.

Furthermore, in the fuel injection device 210, when the fuel is supplied into the fuel space 235, fuel pressure of 5 to 12 MPa is applied to the nozzle portion 231 of the planar wall 228 of the injection hole plate 226, which covers the opening 223 of the valve body 221. However, in the fuel injection device 210, the reinforcing rib 230 is arranged radially outward of the nozzle portion 231 in the injection hole plate 226. Thus, even in the above case where the thickness of the nozzle portion 231 of the planar wall 228 is relatively small, deformation of the planar wall 228 by fuel pressure is advantageously restrained by the reinforcing rib 230. Particularly, in the fuel injection device 210, as discussed above, the reinforcing rib 230 continuously extends in the circumferential direction in the planar wall 228, so that the reinforcing effect of the reinforcing rib 230 is generally uniform in the circumferential direction, resulting in improved durability of the injection hole plate 226. As described above, in the fuel injection device 210, the atomization of fuel mist is promoted while the sufficient pressure resistivity of the injection hole plate 226 against the fuel pressure is achieved with the less number of components. As a result, a reduction in the manufacturing costs and improvement of industrial productivity can be achieved.

(Third Embodiment)

Figure 11:
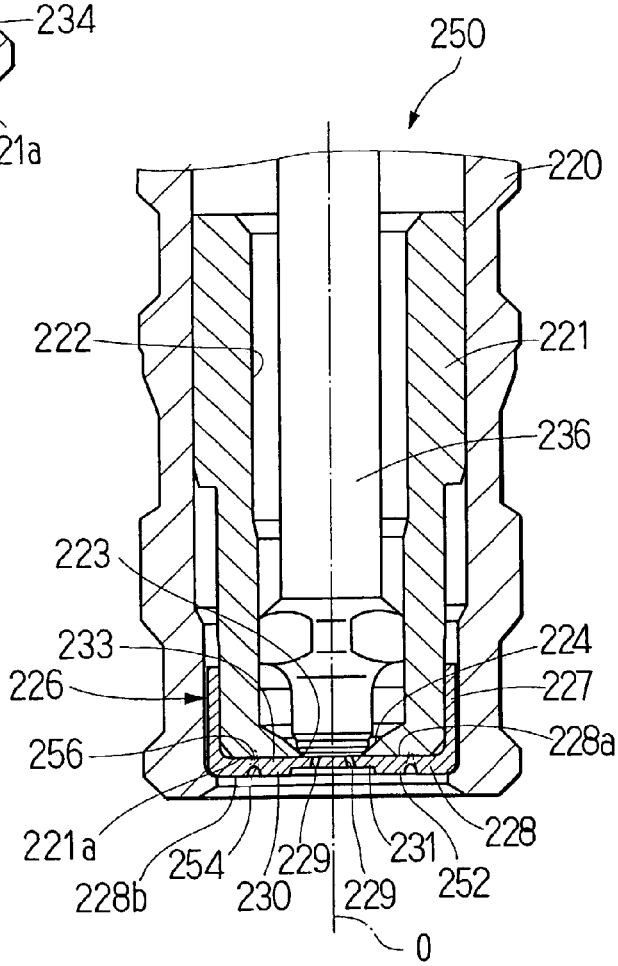
FIG. 11 is a cross sectional view showing a main feature of a fuel injection device according to a third embodiment of the present invention.

FIG. 11 shows a fuel injection device according to a third embodiment of the present invention. Components similar to those discussed with reference to the second embodiment will be indicated by the same numerals.

In the fuel injection device 250 of the third embodiment, a thick wall portion 252, which has a wall thickness thicker than that of the nozzle portion 231 provided with the injection holes 229, is formed in an outer section of the planar wall 228, which is located radially outward of the nozzle portion (inner section) 231 in the planar wall 228 of the injection hole plate 226. The thick wall portion 252 has a generally annular lateral cross section, which extends circumferentially about the axis O. A recessed groove 254 is provided in a radially intermediate section of the thick wall portion 252 and is opened in an outer wall surface 228*b* of the planar wall 228. The groove 254 is an annular groove that extends continuously in the circumferential direction of the thick wall portion 252 about the axis O. In the fuel injection device 250, a radially inward section of the thick wall portion 252, which is located radially inward of the groove 254, forms the reinforcing rib 230 that extends continuously in the circumferential direction of the planar wall 228. Such a reinforcing rib 230 can be easily formed by forming the thick wall portion 252 through, for example, a drawing process, and then by forming the groove 254.

Figure 12A:
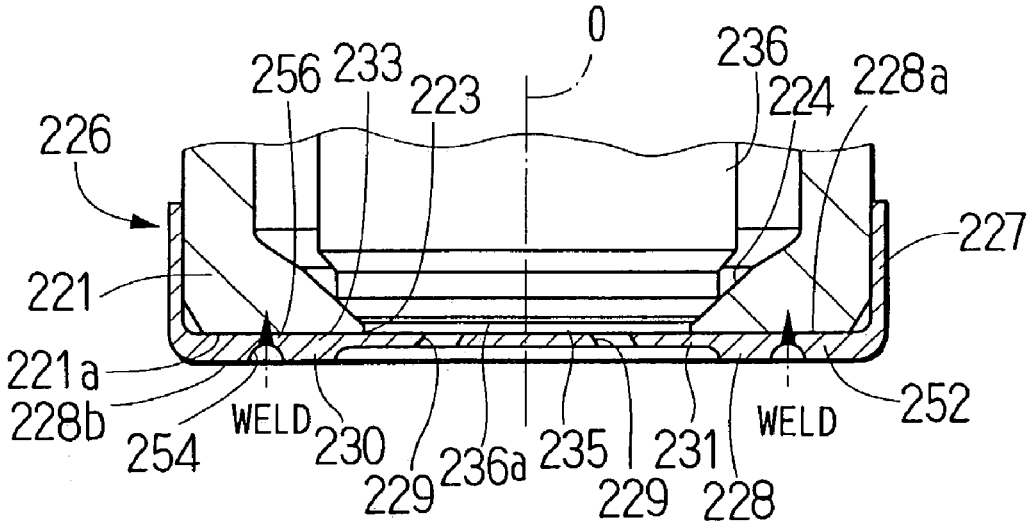
FIG. 12A is an enlarged partial cross sectional view showing welding between an injection hole plate and a valve body in the fuel injection device of the third embodiment.
Figure 12B:
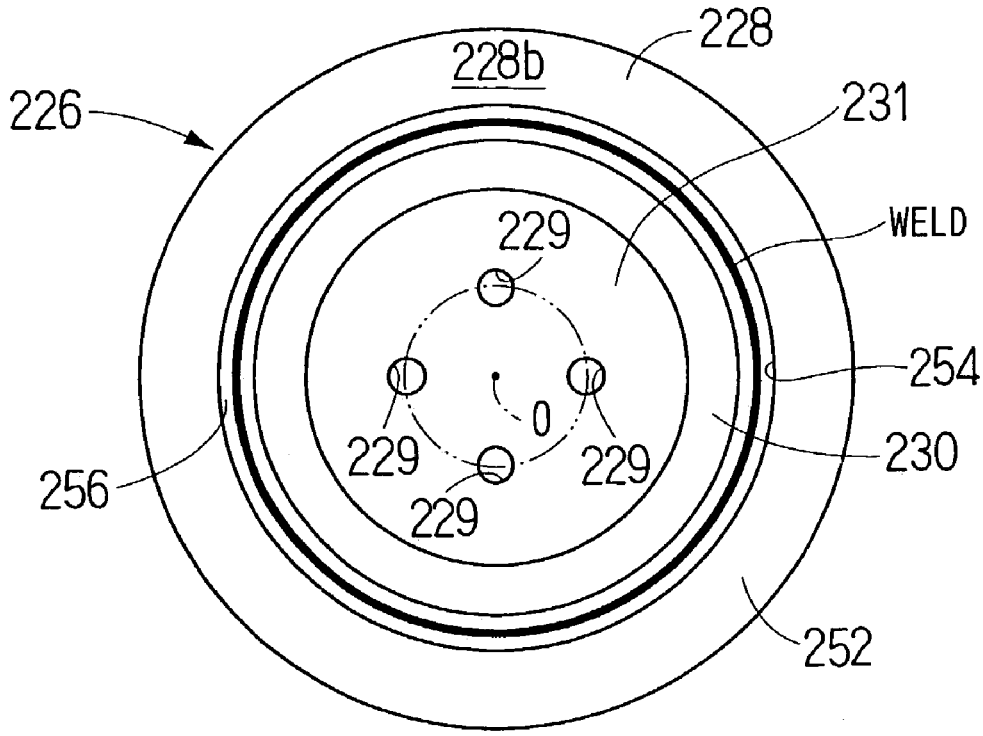
FIG. 12B is a bottom view corresponding to FIG. 12A, showing the welding between the injection hole plate and the valve body in the fuel injection device of the third embodiment.
Figure 13:
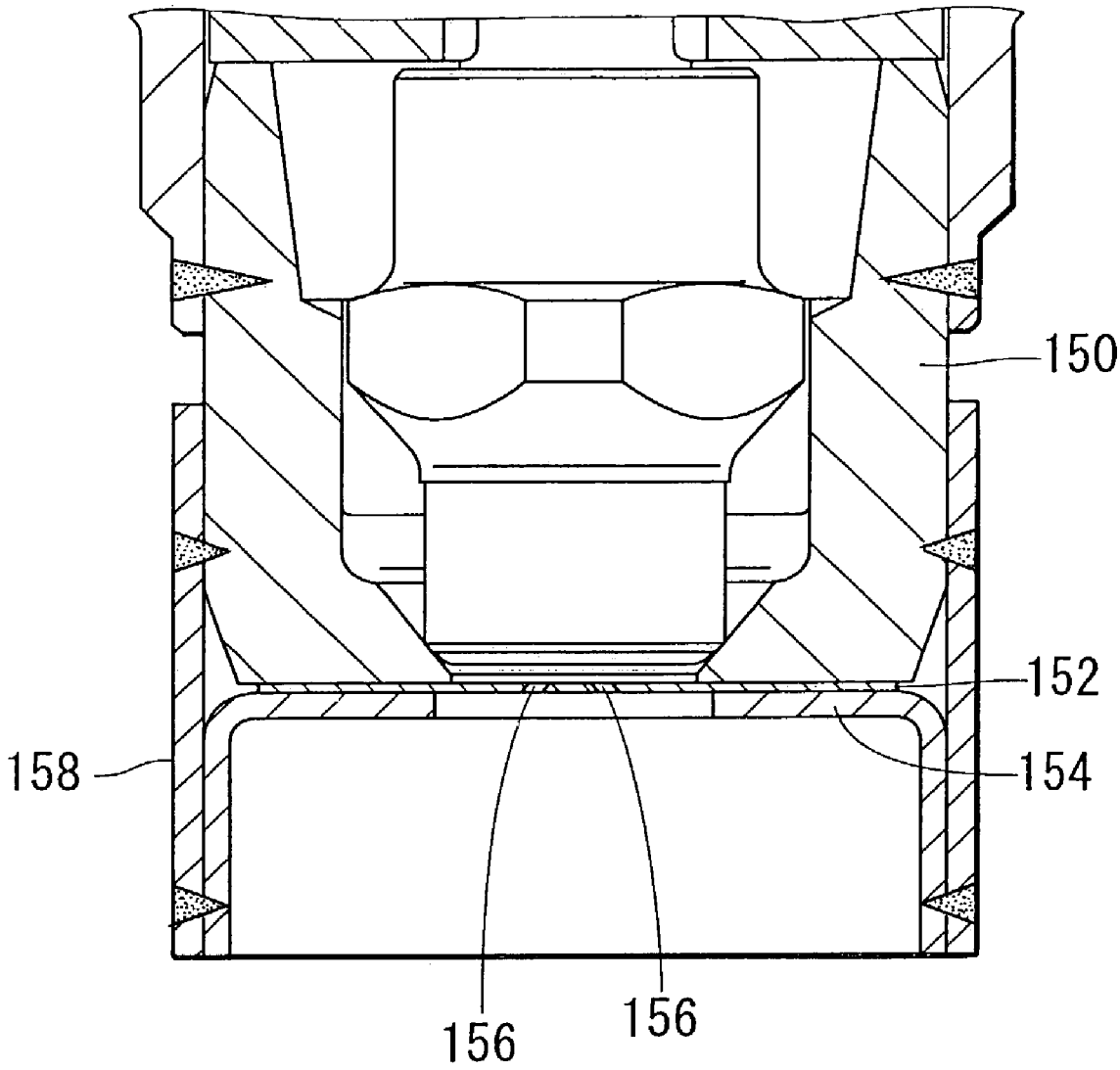
FIG. 13 PRIOR ART
FIG. 13 is an enlarged cross sectional view showing a previously proposed fuel injection device.

Furthermore, in the fuel injection device 250, the axial wall thickness (projecting length) of a bottom part 256 of the groove 254 is generally equal to the axial wall thickness of the nozzle portion 231. Furthermore, the planar wall 228 of the injection hole plate 226 is axially positioned by welding the bottom part 256 of the groove 254 to the valve body 221. In the present embodiment, as shown in FIG. 12A, the bottom part 256 is welded to the downstream end of the valve body 221 all around it by the laser beam, which is irradiated onto the bottom part 256 in a direction generally parallel to the central axis O. In this way, as shown in FIG. 12B, the welding portion (weld) of the planar wall 228 extends continuously in the circumferential direction at the location radially outward of the outermost injection holes 229. In the fuel injection device 250, as discussed above, the bottom part 256, which is thinner than the rest of the thick wall portion 252 of the planar wall 228, is welded to the valve body 221. That is, the bottom part 256, which has a projection length less than that of the reinforcing rib 230, is welded to the valve body 221. Thus, energy consumption at the time of welding can be reduced, and the time required for welding can be also reduced. This allows a reduction in the manufacturing costs and an improvement of industrial productivity.

In the second and third embodiments, the present invention is embodied in the fuel injection device of the direct injection type, which directly injects fuel into the corresponding combustion chamber of the gasoline engine. However, it should be noted that the present invention is also equally applicable to a fuel injection device, which injects fuel into an intake pipe of the gasoline engine. Furthermore, the present invention is not limited to the gasoline engine and can be equally applicable to a diesel engine.

In the second and third embodiments, there is provided the reinforcing rib 230, which extends continuously in the circumferential direction in the planar wall 228 (serving as the cover wall) of the injection hole plate 226. In place of the reinforcing rib 230, it is possible to provide a plurality of discontinuous reinforcing ribs arranged in the circumferential direction of the planar wall 228. In such a case where the discontinuous reinforcing ribs are provided in the third embodiment, the reinforcing ribs can be provided by forming a plurality of discontinuous recessed grooves 254 in the circumferential direction of the planar wall 228.

Furthermore, in the second and third embodiments, the reinforcing rib 230 protrudes on the side (downstream side) of the planar wall 228 of the injection hole plate 226 opposite from valve body 221. Alternatively, it is possible to provide the reinforcing rib 230 on the valve body side (upstream side) of the planar wall 228.

Furthermore, in the second and third embodiments, the welding portion of the planar wall 228 of the injection hole plate 226 extends continuously in the circumferential direction at the location radially outward of the outermost injection holes 229. Alternatively, it is possible to provide a plurality of discontinuous welding portions located radially outward of the outermost injection holes 229.

In the second embodiment, the planar wall 228 of the injection hole plate 226 is welded to the valve body 221 by the laser beam, which is irradiated onto the base portion 233 of the reinforcing rib 230 from the point located radially outward of the reinforcing rib 230. Alternatively, similar to the third embodiment, the welding can be performed by a laser beam, which is irradiated in a direction parallel to the central axis O of the planar wall 228. Apart from this, in the third embodiment, the welding can be performed by a laser beam, which is irradiated onto the base portion 233 of the reinforcing rib 230 from a point located radially outward of the reinforcing rib 230. In the second and third embodiments, the portion 233, 256 of the planar wall 228 of the injection hole plate 226, which is located radially outward of the innermost peripheral edge of the reinforcing rib 230, is welded to the valve body 221. Alternatively, any other suitable portion of the planar wall 228, which has an projecting length that is less that that of the reinforcing rib 230 and is located radially inward of the radially innermost peripheral edge of the reinforcing rib 230, can be welded to the valve body 221.

Furthermore, it is possible to provide a reinforcing rib similar to the reinforcing rib 230 of the second or third embodiment in the injection hole plate 38 of the first embodiment, if desired.

Additional advantages and modifications will readily occur to those skilled in the art. The invention in its broader terms is therefore not limited to the specific details, representative apparatus, and illustrative examples shown and described.

What is claimed is:

1. A fuel injection device comprising:

a valve body that includes:

a downstream end opening;

a fuel passage communicated with the downstream end opening; and a valve seat located adjacent to the downstream end opening;

a valve member that is located radially inward of the valve body and is seatable against the valve seat of the valve body;

an injection hole plate that includes a cover wall, which covers the downstream end opening of the valve body, wherein the cover wall includes:

a thin wall portion, through which at least one injection hole is defined; and a thick wall portion, which is located radially outward of the thin wall portion and has a wall thickness greater than that of the thin wall portion; and a nozzle holder that receives the valve body, wherein:

the nozzle holder includes a support portion, which supports a downstream end surface of the cover wall of the injection hole plate; and a portion of the injection hole plate, which is located radially outward of the thick wall portion, is welded to one of the valve body and the nozzle holder.

2. The fuel injection device according to claim 1, wherein the injection hole plate is clamped between the valve body and the support portion of the nozzle holder.

3. The fuel injection device according to claim 1, wherein the injection hole plate is clamped between the valve body and the nozzle holder.

4. The fuel injection device according to claim 1, wherein:

the injection hole plate further includes a peripheral wall, which extends from the cover wall in an upstream direction; and the peripheral wall is fitted to one of the valve body and the nozzle holder.

5. The fuel injection device according to claim 4, wherein the cover wall of the injection hole plate is welded to the one of the valve body and the nozzle holder at a welding portion, which is located radially outward of the injection hole.

6. The fuel injection device according to claim 1, wherein a downstream end surface of the valve member is generally flat.

7. The fuel injection device according claim 1, wherein a downstream end of the valve member and the injection hole plate define a generally flat fuel space therebetween.

8. The fuel injection device according to claim 1, wherein the fuel injection device is of a direct injection type that directly injects fuel into a combustion chamber of an internal combustion engine.

9. A fuel injection device comprising:

a valve body that includes:

a downstream end opening;

a fuel passage communicated with the downstream end opening; and a valve seat located adjacent to the downstream end opening;

a valve member that is located radially inward of the valve body and is seatable against the valve seat of the valve body;

an injection hole plate that includes a cover wall, which covers the downstream end opening of the valve body, wherein the cover wall includes at least one injection hole formed through the cover wall; and a nozzle holder that receives the valve body, wherein:

the nozzle holder includes a support portion, which supports a downstream end surface of the cover wall of the injection hole plate;

the cover wall of the injection hole plate includes a thin wall portion and a thick wall portion, wherein the thin wall portion covers the downstream end opening of the valve body, and the thick wall portion is formed around the thin wall portion;

a portion of the injection hole plate, which is located radially outward of the thick wall portion, is welded to one of the valve body and the nozzle holder; and the at least one injection hole is formed through the thin wall portion of the cover wall.

10. A fuel injection device according to claim 9, wherein the injection hole plate is clamped between the valve body and the nozzle holder.

11. A fuel injection device according to claim 9, wherein: the injection hole plate further includes a peripheral wall, which extends from the cover wall in an upstream direction; and the peripheral wall is fitted to one of the valve body and the nozzle holder.

12. A fuel injection device according to claim 11, wherein the cover wall of the injection hole plate is welded to one of the valve body and the nozzle holder at a welding portion, which is located radially outward of the injection hole.

13. A fuel injection device comprising:

a valve body that includes:

a downstream end opening;

a fuel passage communicated with the downstream end opening; and a valve seat located adjacent to the downstream end opening;

a valve member that is located radially inward of the valve body and is seatable against the valve seat of the valve body; and an injection hole plate that includes a cover wall, which covers the downstream end opening of the valve body, wherein the cover wall includes at least one injection hole formed through the cover wall, wherein:

the cover wall includes a reinforcing rib located radially outward of the injection hole; and a portion of the cover wall, which has a projecting length smaller than that of the reinforcing rib, is welded to the valve body.

14. The fuel injection device according to claim 13, wherein:

the injection hole plate further includes a peripheral wall, which extends from the cover wall in an upstream direction; and a downstream end of the valve body is located radially inward of the peripheral wall of the injection hole plate.

15. The fuel injection device according to claim 13, wherein the portion of the cover wall, which is welded to the valve body, is located radially outward of a radially innermost peripheral edge of the reinforcing rib.

16. The fuel injection device according to claim 13, wherein the portion of the cover wall, which is welded to the valve body, is located radially outward of the injection hole and extends continuously in a circumferential direction.

17. The fuel injection device according to claim 13, wherein the reinforcing rib extends continuously in a circumferential direction of the cover wall.

18. The fuel injection device according to claim 13, wherein the reinforcing rib protrudes in a downstream direction from a downstream end surface of the cover wall.

19. The fuel injection device according to claim 18, wherein the portion of the cover wall, which is welded to the valve body, is a base portion of the reinforcing rib.

20. The fuel injection device according to claim 19, wherein the cover wall is laser welded to the valve body by a laser beam irradiated onto the base portion from a point located radially outward of the reinforcing rib.

21. The fuel injection device according to claim 13, wherein:

an outer section of the cover wall located radially outward of the injection hole forms a thick wall portion that has a wall thickness greater than that of an inner section of the cover wall, which is located radially inward of the outer section of the cover wall and has the injection hole;

the thick wall portion includes a recessed groove, wherein the reinforcing rib is arranged radially inward of the recessed groove; and the portion of the cover wall, which is welded to the valve body, is a bottom part of the recessed groove.

22. The fuel injection device according to claim 1, wherein said thick wall portion comprises a reinforcing rib and wherein a wall portion of the cover wall located radially outward of the reinforcing rib has a wall thickness less than that of the reinforcing rib.

23. The fuel injection device according to claim 1, wherein said thick wall portion is not substantially supported by said support portion of the nozzle holder.

24. The fuel injection device according to claim 1, wherein said support portion supports substantially solely an outer peripheral edge of said thick portion.

25. A fuel injection device comprising:

a valve body that includes:

a downstream end opening;

a fuel passage communicated with the downstream end opening; and a valve seat located adjacent to the downstream end opening;

a valve member that is located radially inward of the valve body and is seatable against the valve seat of the valve body;

an injection hole plate that includes a cover wall, which covers the downstream end opening of the valve body, wherein the cover wall includes:

a thin wall portion, through which at least one injection hole is defined; and a thick wall portion, which is located radially outward of the thin wall portion and has a wall thickness greater than that of the thin wall portion, wherein the thick wall portion includes a reinforcing rib, and a wall portion of the cover wall located radially outward of the reinforcing rib has a wall thickness less than that of the reinforcing rib; and a nozzle holder that receives the valve body, wherein:

the nozzle holder includes a support portion, which supports a downstream end surface of the cover wall of the injection hole plate; and the injection hole plate is welded to one of the valve body and the nozzle holder.

* * * * *